US011600204B2

(12) United States Patent
Wallen

(10) Patent No.: US 11,600,204 B2
(45) **Date of Patent: *Mar. 7, 2023**

(54) REMOVABLY SECURING A SLICEFORM TO A FOLDABLE ARTICLE

(71) Applicant: HALLMARK CARDS, INCORPORATED, Kansas City, MO (US)

(72) Inventor: Thomas A. Wallen, Merriam, KS (US)

(73) Assignee: HALLMARK CARDS, INCORPORATED, Kansas City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/559,727

(22) Filed: Dec. 22, 2021

(65) Prior Publication Data

US 2022/0114918 A1 Apr. 14, 2022

Related U.S. Application Data

(63) Continuation of application No. 17/028,613, filed on Sep. 22, 2020, now Pat. No. 11,238,758, which is a continuation-in-part of application No. 16/901,960, filed on Jun. 15, 2020, now Pat. No. 11,443,655, which is a continuation of application No. (Continued)

(51) Int. Cl.

| | |
|---|---|
| ***G09F 1/08*** | (2006.01) |
| ***G09F 1/06*** | (2006.01) |
| ***B42D 15/04*** | (2006.01) |

(52) U.S. Cl.
CPC ..... *G09F 1/08* (2013.01); *B42D 15/042* (2013.01); *G09F 1/06* (2013.01)

(58) Field of Classification Search
CPC ..... G09F 1/08; G09F 1/06; B42D 15/042
See application file for complete search history.

(56) References Cited

U.S. PATENT DOCUMENTS 930,108 A * 8/1909 Walcutt ..... A63H 33/38 119/431
1,052,187 A * 2/1913 Stranders ..... G09F 1/06 40/539

(Continued)

OTHER PUBLICATIONS

"Automatic Sliding Tab Tutorial | The Little Green Box", LittleGreenBox.Wordpress.com, published on Mar. 7, 2011, Retrieved from Internet: <URL: https://littlegreenbox.wordpress.com/2011/03/07/automatic-slidin- g-tab-tutorial/, accessed on Apr. 19, 2021, pp. 1-10.

(Continued)

*Primary Examiner* — Gary C Hoge
(74) *Attorney, Agent, or Firm* — Shook, Hardy & Bacon L.L.P.

(57) ABSTRACT

A foldable article having a sliceform removably secured to one or more panels of the foldable article. A tab having a retaining portion may extend from at least one of the one or more panels of the foldable article. The tab may pass through an opening in the sliceform and the retaining portion may be wider than the width of the opening. The retaining member may be manipulated to pass through the opening to removably secure the sliceform to, and/or detach the sliceform from, the foldable article.

19 Claims, 10 Drawing Sheets

Related U.S. Application Data

16/425,597, filed on May 29, 2019, now Pat. No. 10,713,975.

(60) Provisional application No. 62/678,033, filed on May 30, 2018.

(56) References Cited

U.S. PATENT DOCUMENTS

| | | | | |
|---|---|---|---|---|
| 1,194,678 | A * | 8/1916 | Stranders | G09F 1/06 40/539 |
| 3,090,144 | A | 5/1963 | Malamude | |
| 3,235,988 | A | 2/1966 | Paige | |
| 3,668,796 | A | 6/1972 | Patterson | |
| 4,113,109 | A * | 9/1978 | Donnelli | B65D 77/22 211/49.1 |
| 4,349,973 | A * | 9/1982 | Penick | G09F 1/06 446/148 |
| 4,833,802 | A | 5/1989 | Volkert | |
| 5,010,669 | A | 4/1991 | Moran | |
| 5,022,681 | A | 6/1991 | Penick | |
| 5,305,705 | A | 4/1994 | Gagliano | |
| 5,450,680 | A | 9/1995 | Bromberg | |
| 5,626,232 | A | 5/1997 | Volkert et al. | |
| 5,682,999 | A | 11/1997 | Larson | |
| 5,738,221 | A | 4/1998 | Van Witt et al. | |
| 5,817,378 | A | 10/1998 | Otani | |
| 5,933,989 | A | 8/1999 | Volkert et al. | |
| 5,937,553 | A | 8/1999 | Maran | |
| 5,943,800 | A * | 8/1999 | Rose | G09F 1/06 446/148 |
| 6,238,762 | B1 | 5/2001 | Friedland et al. | |
| 6,311,142 | B1 | 10/2001 | Glassner | |
| 6,386,370 | B1 | 5/2002 | Wigton et al. | |
| 6,966,135 | B1 | 11/2005 | McDonald | |
| 7,490,425 | B2 | 2/2009 | Crowell et al. | |
| 7,938,270 | B2 | 5/2011 | Davis | |
| 8,499,478 | B1 | 8/2013 | Glass et al. | |
| 9,334,076 | B2 | 5/2016 | Flynn et al. | |
| 9,475,333 | B2 * | 10/2016 | Yeh | B44C 5/06 |
| 9,524,658 | B1 | 12/2016 | Wise et al. | |
| 9,542,865 | B2 | 1/2017 | Simmons | |
| 9,601,033 | B2 | 3/2017 | Wise et al. | |
| 9,643,443 | B2 | 5/2017 | Bogdanski et al. | |
| 9,836,997 | B1 | 12/2017 | Brandrup | |
| 9,842,516 | B2 | 12/2017 | Yeh | |
| 9,873,280 | B1 | 1/2018 | Nelson et al. | |
| 9,981,777 | B1 * | 5/2018 | Thomson | B65D 5/4208 |
| 10,339,838 | B2 | 7/2019 | Wise et al. | |
| 2003/0097773 | A1 * | 5/2003 | Oh | G09F 1/06 40/124.08 |
| 2006/0086015 | A1 | 4/2006 | Zlotnick et al. | |
| 2007/0017133 | A1 * | 1/2007 | Crowell | G09F 15/00 40/610 |
| 2007/0293118 | A1 | 12/2007 | Prescott | |
| 2008/0016732 | A1 | 1/2008 | Gardi | |
| 2008/0229633 | A1 | 9/2008 | Yi | |
| 2008/0236000 | A1 | 10/2008 | Bostick | |
| 2011/0047839 | A1 | 3/2011 | Ross et al. | |
| 2012/0285861 | A1 | 11/2012 | Glass et al. | |
| 2013/0139420 | A1 * | 6/2013 | Rubar | G09F 1/06 493/54 |
| 2013/0191083 | A1 | 7/2013 | Bachrach et al. | |
| 2016/0358515 | A1 | 12/2016 | Christiansen | |
| 2016/0365009 | A1 | 12/2016 | Wise et al. | |
| 2016/0365010 | A1 * | 12/2016 | Wise | G09F 1/08 |
| 2017/0148358 | A1 | 5/2017 | Wise et al. | |
| 2017/0178544 | A1 | 6/2017 | Yeh | |
| 2018/0102070 | A1 * | 4/2018 | Yeh | G09F 1/08 |
| 2018/0102071 | A1 | 4/2018 | Yeh | |

OTHER PUBLICATIONS

"Cutpopup Orea Whale Card Pop Up, 3D Birthday Card Pop Up for Daughter, Son, Nephew, Niece—Wonderful Gift for Children, Kids, Teenager, Pre School on Birthday, Pool Swim Party, Christmas, New Year", Amazon.com, Retrieved from internet URL: https://www.amazon.com/CUTPOPUP-Intricate-Aesthetic-Protection-Enthusiast- /dp/B079JWT49P?th=1, accessed on Apr. 19, 2021, pp. 1-11.

"Papercrafts and other fun things: Sliceforms are my new obsession", Blog, Retrieved from Internet URL : https://papercraftetc.blogspot.com/2013/07/sliceforms-are-my-new-obsession.html, accessed on Jun. 16, 2021, pp. 4 (Jul. 8, 2013).

"Sliceforms—The background", Blog at Wordpress.com, Retrieved from Internet URL : https://web.archive.org/web/20131114220824/https://sliceforms.wordpress.com/2010/11/22/, accessed on Mar. 15, 2022, pp. 4 (Nov. 22, 2010).

Office Action dated Feb. 3, 2022 received in Canadian Patent Application No. 3101970, 4 pages.

Notice of Allowance dated Apr. 11, 2022 in U.S. Appl. No. 16/901,960, 7 pages.

Notice of Allowance dated May 4, 2022 in U.S. Appl. No. 16/901,960, 5 pages.

Non-Final Office Action dated Dec. 14, 2022 in U.S. Appl. No. 17/901,825, 8 pages.

* cited by examiner

REMOVABLY SECURING A SLICEFORM TO A FOLDABLE ARTICLE

CROSS-REFERENCE TO RELATED APPLICATIONS

This application is a continuation of pending U.S. application Ser. No. 17/028,613, filed Sep. 22, 2020, and entitled "Removably Securing a Sliceform to a Foldable Article", which is a continuation-in-part of pending U.S. application Ser. No. 16/901,960, filed Jun. 15, 2020, and entitled "Removably Securing a Sliceform to a Foldable Article", which is a continuation of U.S. application Ser. No. 16/425,597, filed May 29, 2019, and entitled "Removably Securing a Sliceform to a Foldable Article," which issued as U.S. Pat. No. 10,713,975 on Jul. 14, 2020, which claims the benefit of U.S. Provisional Application No. 62/678,033, filed May 30, 2018, and entitled "Removably Securing a Sliceform to a Foldable Article". The entireties of the aforementioned applications are incorporated by reference herein.

TECHNICAL FIELD

The present invention relates generally to removably securing a sliceform to a foldable article. More particularly, the present invention relates generally to removably securing a sliceform in products that contain two hinged planes that move toward and away from one another, for example, greeting cards, books, invitations, boxes, and other objects with flaps.

BACKGROUND

Technology may be added to a greeting card or the like to make a compelling event occur (for example, expansion of a sliceform from a collapsed state to a three-dimensional state) when a consumer interacts with the greeting card or like object. It would be desirable that a sliceform included in a foldable article be removably secured thereto so as to permit removal of the sliceform from the foldable article. Historically, sliceforms have been permanently affixed to foldable articles. It would also be desirable to have an alternate means of securing a sliceform to a foldable article with a minimum of wasted material and/or without the need for adhesives.

SUMMARY

This summary is provided to introduce a selection of concepts in a simplified form that are further described below in the detailed description section. This summary is not intended to identify key features or essential features of the claimed subject matter, nor is it intended to be used as an aid in determining the scope of the claimed subject matter. The scope of the invention is defined by the claims.

Embodiments of the present invention are directed to systems and methods of removably securing a sliceform to a foldable article. For example, it may be desirable to secure a sliceform within a foldable article (e.g., a greeting card, book, etc.) in a manner such that the sliceform may be removed from the foldable article without damaging the sliceform and/or foldable article and without disassembling the sliceform. Aspects herein provide for securing a sliceform to a foldable article by threading tabs and retaining portions through openings in the sliceform. The retaining portions are sized to restrict movement of the tab through the opening and consequently restrict movement of the sliceform away from the foldable article. The sliceform may be removed from the foldable article by manipulating the retaining portions to a size that may pass back through the opening in the sliceform.

BRIEF DESCRIPTION OF THE SEVERAL VIEWS OF THE DRAWINGS

The present invention is explained in more detail below with reference to the embodiments illustrated in the attached drawing figures, in which like reference numerals denote like elements, in which FIGS. 1-9 illustrate three possible embodiments of the present invention, and in which:

FIG. 1 is a front perspective view of a foldable article in an open position having a sliceform removably secured thereto, in accordance with an embodiment of the present invention;

FIG. 2 is a top view of the sliceform of FIG. 1;

FIG. 3 is a front view of base panels forming a portion of the sliceform of FIG. 1;

FIG. 4 is a front view of vertical panels forming a portion of the sliceform of FIG. 1;

FIG. 5 is a front perspective view of the foldable article of FIG. 1;

FIG. 6 is a front perspective view of an alternative foldable article, in accordance with a second embodiment of the present invention;

FIG. 7 is a detailed perspective view of the third subpanel of FIG. 1;

FIG. 8 is a detailed perspective view of an alternative third subpanel, in accordance with a third embodiment of the present invention;

FIG. 9 is a top view of the sliceform removably secured to the foldable article of FIG. 1 with the foldable article in the open position;

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or a combination of steps similar to the ones described in this document, in conjunction with other present or future technologies.

Embodiments of the present invention are directed to systems comprising a foldable article having a sliceform removably secured to the foldable article and methods of removably securing a sliceform to a foldable article. For example, it may be desirable to secure a sliceform within a foldable article (e.g., a greeting card, book, etc.) in a manner such that the sliceform may be removed from the foldable article without damaging the sliceform and/or foldable article and/or without disassembling the sliceform. Aspects herein provide for securing a sliceform to a foldable article by threading tabs and retaining portions through openings in the sliceform. The retaining portions are sized to restrict movement of the tab through the opening and consequently restrict movement of the sliceform away from the foldable article. The sliceform may be removed, in these aspects, from the foldable article by manipulating (e.g., folding, bending, etc.) the retaining portions to a size that allows them to pass back through the opening in the sliceform. Other aspects discussed herein provide for securing a sliceform to a foldable article by interlocking slits in the tabs and/or retaining portions with slots in the sliceform in a manner similar to how the sliceform elements interlock. The sliceform may be removed, in these aspects, from the foldable article by decoupling the tabs and/or retaining portions from the sliceform.

Some aspects of the present invention may be described using relative location terminology. For example, the term "proximate" is intended to mean on, about, near, by, next to, at, and the like. Therefore, when a feature is proximate another feature, it is close in proximity but not necessarily exactly at the described location, in some aspects. The term "substantially" when used in relation to angular orientation means within ±5 degrees of a designated value. Thus, when an element is substantially parallel to another element, it may be parallel, or nearly parallel but not exactly parallel. For example, when sliceforms such as those described herein are in a collapsed state, each of the planar elements may be oriented such that they extend in nearly parallel directions, but not necessarily in exact parallel alignment with one another or with a panel of the foldable article.

Figure 1:
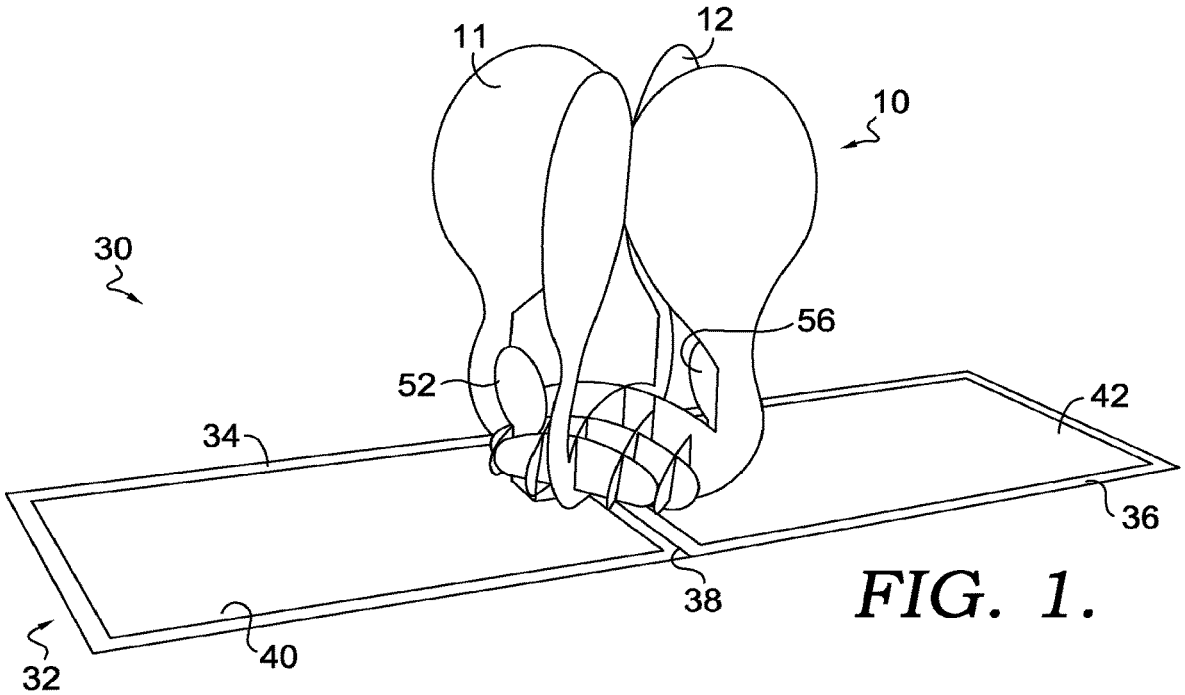

Sliceforms useful with the present invention generally include a plurality of cooperating panels that are configured to move between a first collapsed, substantially flat configuration and a second three-dimensional configuration. An example sliceform is illustrated in FIG. 1 and is generally designated with reference number 10. Sliceform 10 includes vertical panel 11, vertical panel 12, base panel 13, base panel 14, base panel 15, base panel 16, base panel 17, base panel 18, base panel 19, and base panel 20. The vertical panels 11 and 12 and the base panels 13, 14, 15, 16, 17, 18, 19, and 20 cooperate to form a grid-like structure. Generally, the base panels 13, 14, 15, 16, 17, 18, 19, and 20 provide a base above which the vertical panels 11 and 12 are supported. The vertical panels 11 and 12 may include decorative elements.

It is envisioned that any number of the panels comprising a sliceform (e.g., the sliceform 10) may be either vertical panels (e.g., vertical panels 11 and 12) or base panels (e.g., base panels 13, 14, 15, 16, 17, 18, 19, and 20). In other words, any ratio of vertical panels to base panels is contemplated within the scope of the present invention. In some aspects, all of the panels may be vertical panels (e.g., vertical panels 11 and 12). In other aspects, all of the panels may be base panels (e.g., base panels 13, 14, 15, 16, 17, 18, 19, and 20).

Figure 2:
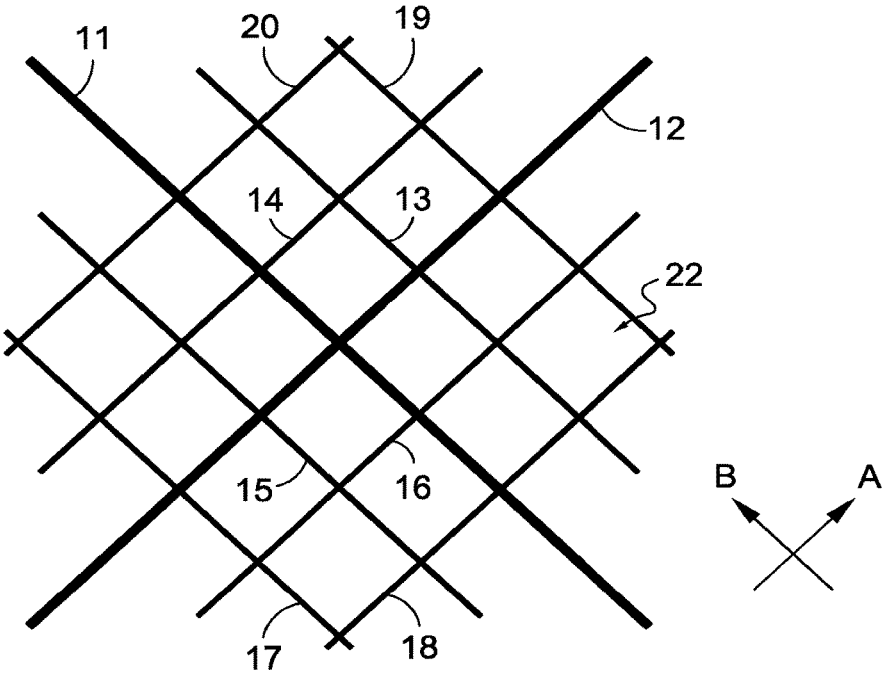

The grid-like structure of the sliceform 10 formed when the sliceform 10 is in the second three-dimensional configuration is shown in FIG. 2, which illustrates a top-view of the sliceform 10. A number of openings 22 in the grid-like structure of the sliceform 10 are apparent and are generally defined by adjacent and intersecting base panels (e.g., 13, 14, 15, 16, 17, 18, 19, and 20) and/or vertical panels (e.g., 11 and 12). In other words, the openings 22 may comprise passageways through the sliceform 10 that are formed when the sliceform 10 is in the second, three-dimensional configuration. In alternative aspects, however, the openings may comprise slits or other shaped apertures formed in one or more of the base panels 13, 14, 15, 16, 17, 18, 19, and 20 and/or the vertical panels 11 and 12. In these aspects, the tabs and retaining portions described below are inserted through the slits or other shaped aperture to removably secure the sliceform 10 to the foldable article.

When the sliceform 10 is in the second three-dimensional configuration, some of the panels extend in a first direction that is labeled as direction A in FIG. 2. Some of the other panels extend in a second direction that is labeled as direction B in FIG. 2. Direction A and direction B are illustrated as perpendicular to one another. In other aspects, however, direction A and direction B may not be perpendicular so long as such directions intersect (i.e., are not parallel) with each other.

Figure 3:
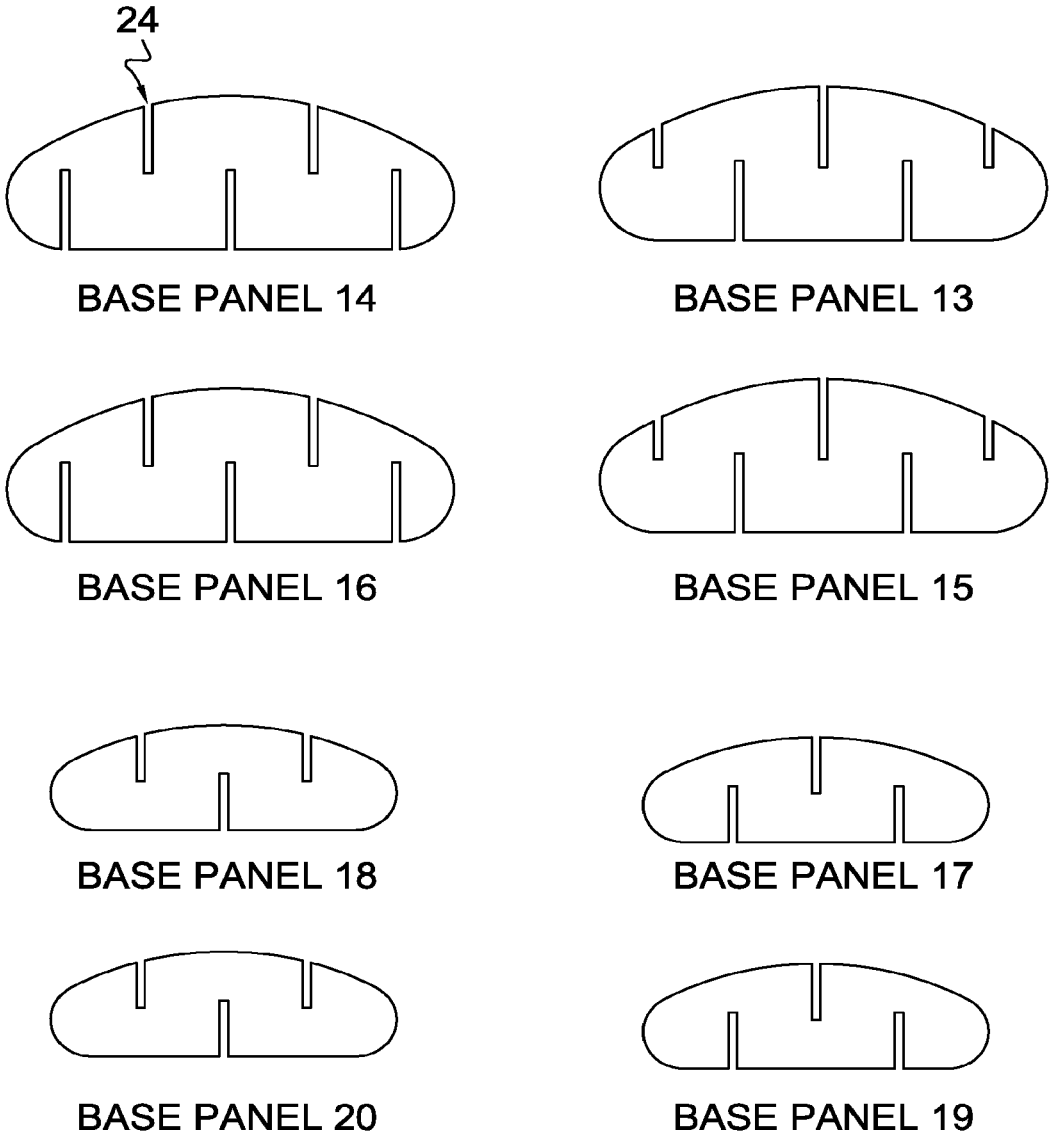
Figure 4:
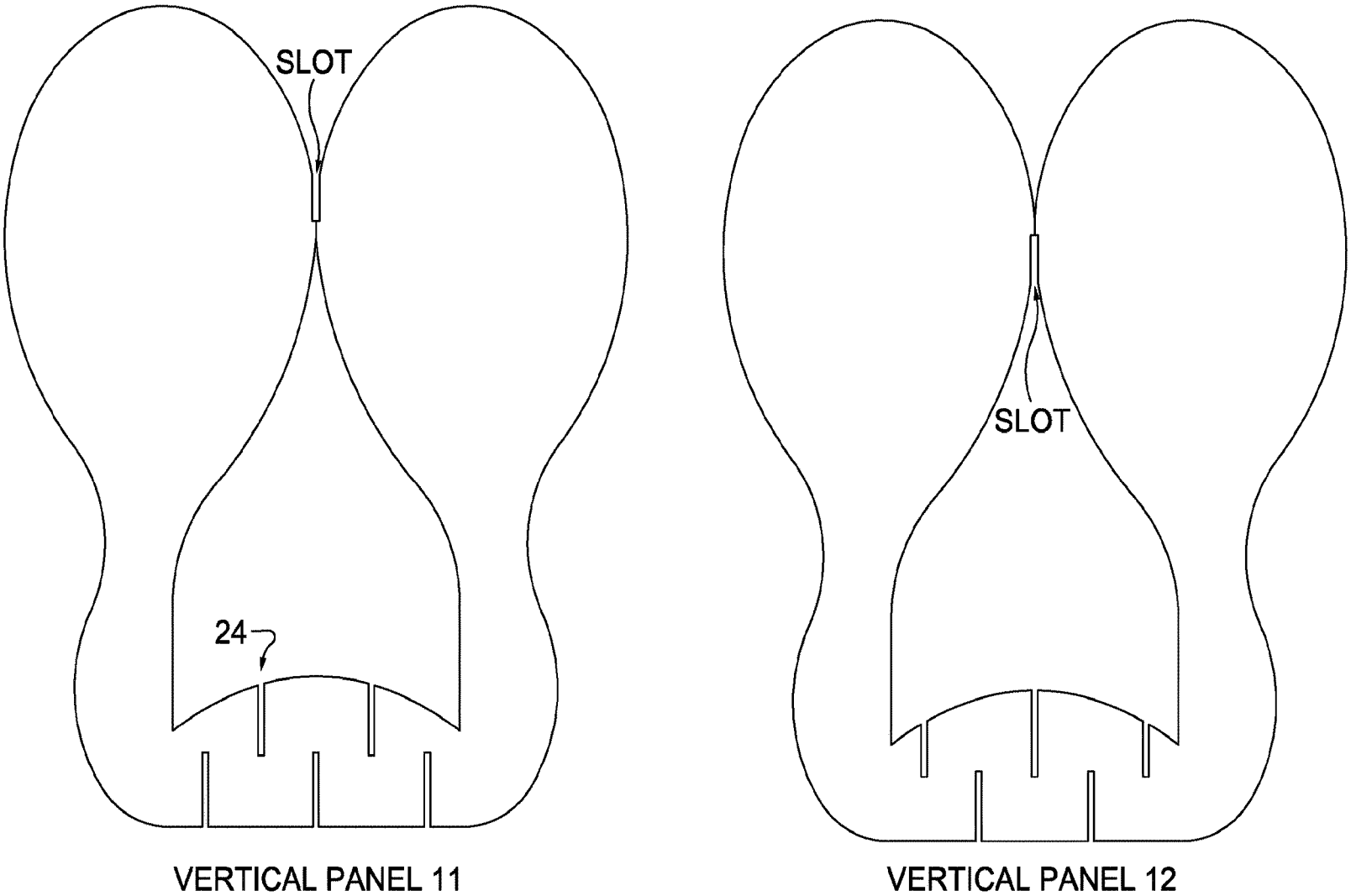

The base panels 13, 14, 15, 16, 17, 18, 19, and 20 and the vertical panels 11 and 12 include slots 24 formed therein. Turning to FIGS. 3 and 4, the slots 24 of each of the base panels 13, 14, 15, 16, 17, 18, 19, and 20 and the vertical panels 11 and 12 of the sliceform 10 are illustrated. These slots allow all of the panels to cooperate and permit the sliceform 10 to move between the first collapsed, substantially flat configuration and the second three-dimensional configuration.

Returning to FIG. 1, the sliceform 10 is shown removably secured to a foldable article 30. In the illustrated aspect, the foldable article 30 is a greeting card. It is envisioned, however, that any type of foldable article is suitable for the present invention. For example, the concepts of the present invention could equally be applied to other products that contain two hinged planes that move toward and away from one another, for example, books, invitations, boxes, and other objects with flaps.

Figure 5:
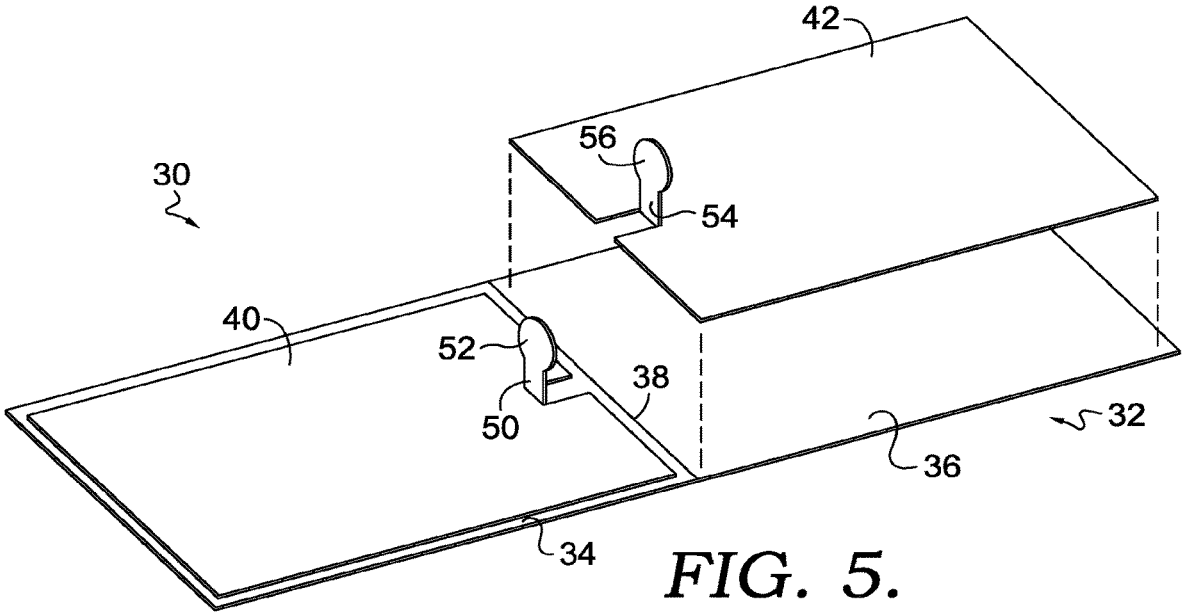

The foldable article 30 illustrated in FIG. 1 includes a panel 32 having a first subpanel 34 separated from a second subpanel 36 by a fold 38. As shown in FIG. 5, a third subpanel 40 is affixed to the first subpanel 34. A fourth subpanel 42 is shown lifted away from the second subpanel 36, but may likewise be affixed thereto. In the illustrated aspect, the third subpanel 40 and the fourth subpanel 42 are discrete pieces affixed to the first subpanel 34 and the second subpanel 36, respectively.

Figure 6:
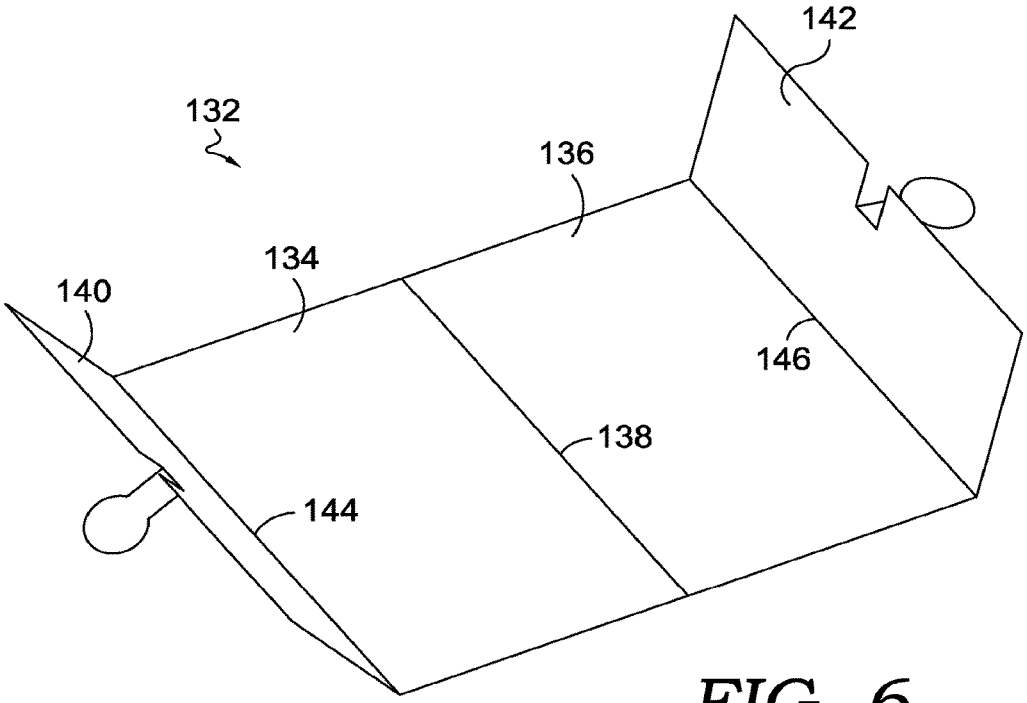

In an alternative embodiment illustrated in FIG. 6, however, the panel 132 has a third subpanel 140 joined to the first subpanel 134 opposite the second subpanel 136. Likewise, the panel 132 has a fourth subpanel 142 joined to the second subpanel 136 opposite the first subpanel 134. In the alternative embodiment of FIG. 6, the third subpanel 140 is separated from the first subpanel 134 by a second fold 144 and the fourth subpanel 142 is separated from the second subpanel 136 by a third fold 146. The panel 132 may be assembled by first folding the third subpanel 140 over the second fold 144 and then affixing the third subpanel 140 to the first subpanel 134. Similarly, the fourth subpanel 142 may be first folded over the third fold 146 before then affixing the fourth subpanel 142 to the second subpanel 136.

Figure 7:
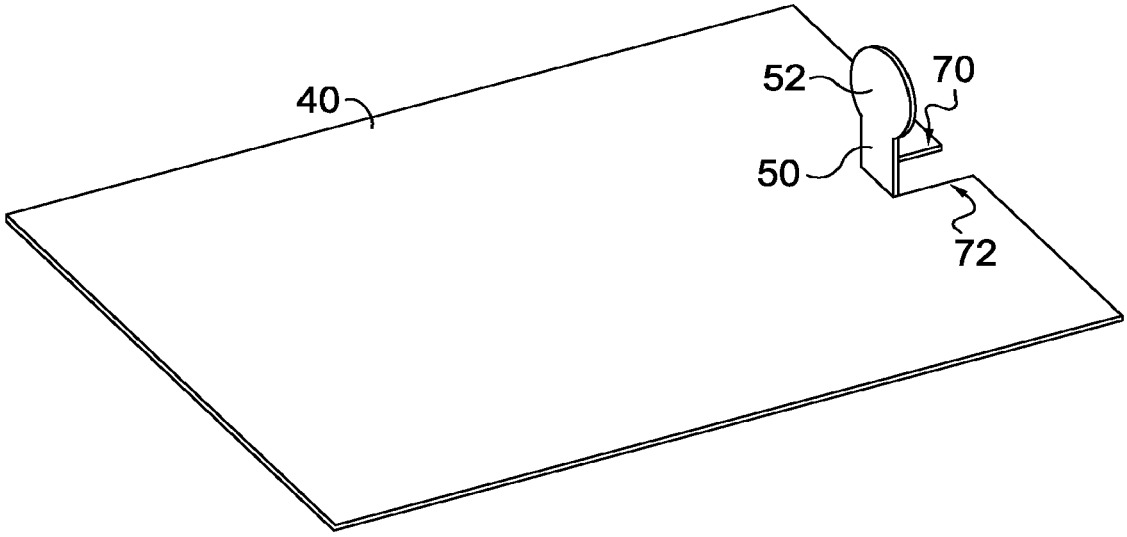

Turning now to FIG. 7, a detailed view of the third subpanel 40 of the panel 32 is illustrated. For the sake of brevity, the following description will only discuss aspects of the third subpanel 40. This discussion, however, applies equally to the fourth subpanel 42 unless specifically noted otherwise.

In FIG. 7, the third subpanel 40, includes a first tab 50 having a first retaining portion 52. In the illustrated aspect, the first retaining portion 52 is integrally formed with the first tab 50. The first retaining portion 52 is wider than the first tab 50. In some aspects, the third subpanel 40 may be die cut from a larger article. The die cutting may result in the removal of excess material and also in the cuts between the first tab 50 and the edges 70 and 72. These cuts allow the first tab 50 to move between a first position (not shown) where the first tab 50 is flush with the third subpanel 40 and a second position (shown in FIG. 7) where the first tab 50 is perpendicular to the third subpanel 40. In this way, the first tab 50 and the first retaining portion 52 may be formed without the need for adhesives or other affixing means.

Figure 8:
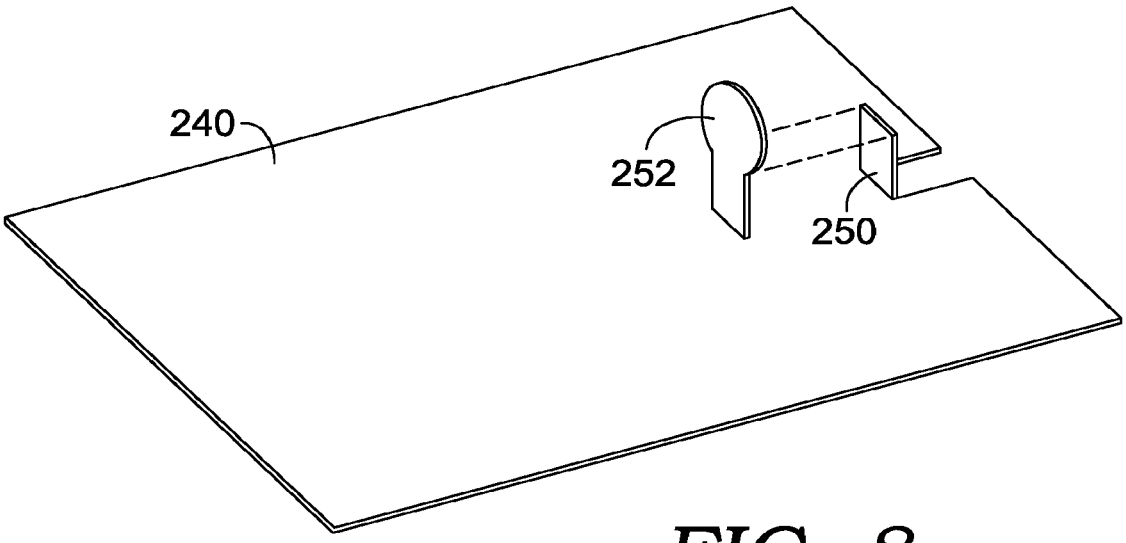

In an alternative embodiment illustrated in FIG. 8, a tab 250 is formed in a third subpanel 240 separately from a retaining portion 252. In this alternative embodiment, two equal cuts in the third subpanel 240 may form the tab 250. Further, the retaining portion 252 may then be affixed (e.g., with an adhesive, taping, etc.) to the tab 250 to form a unitary tab and retaining portion. In this way, less material may be used and less material may be wasted as compared with die cutting excess material away from a rectangular sheet.

Returning to FIG. 5, the fourth subpanel 42 includes a second tab 54 and a second retaining portion 56. The third subpanel 40 is oriented with the first tab 50 proximate the fold 38. Likewise, the fourth subpanel 42 is oriented with the second tab 54 proximate the fold 38.

Figure 9:
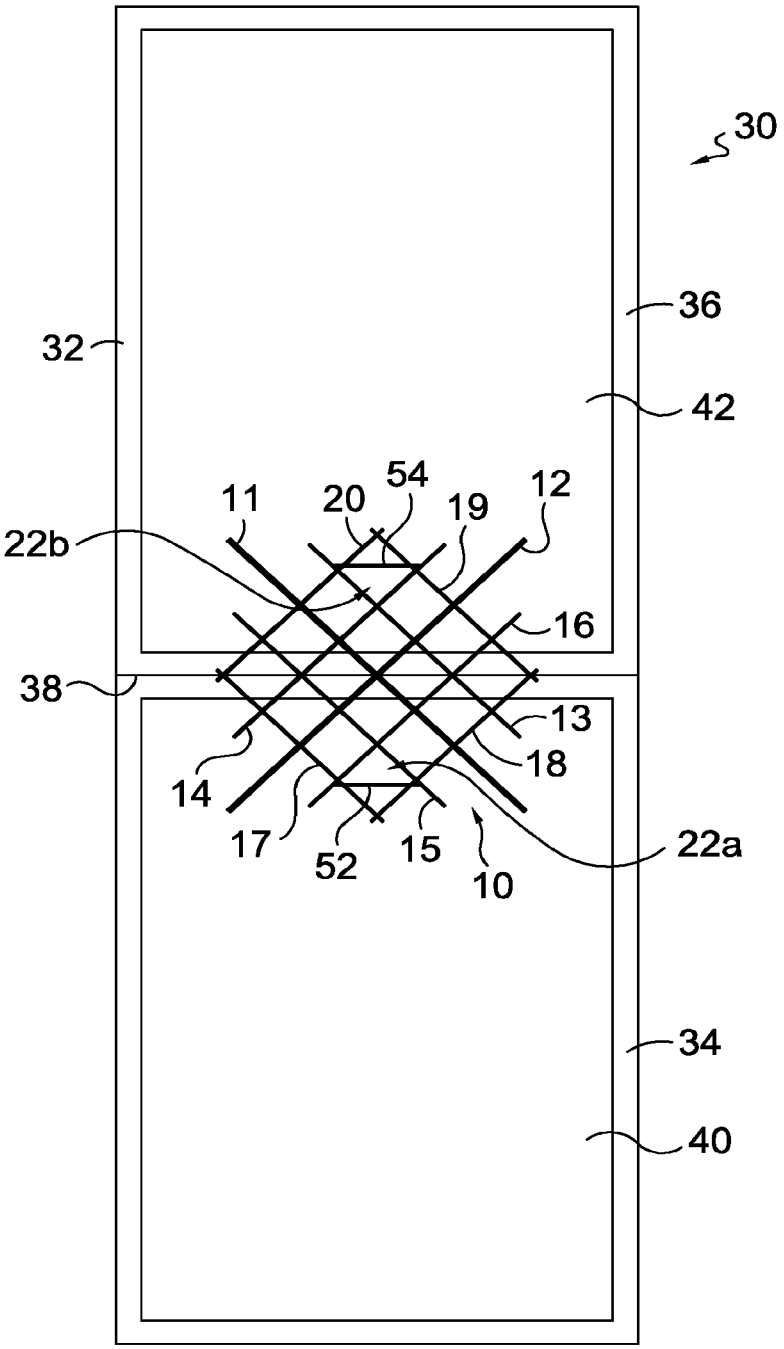

Turning now to FIG. 9 and with continued reference to FIG. 1, the sliceform 10 is removably secured to the panel 32 by the first tab 50 and second tab 54. More specifically, the first tab 50 and the first retaining portion 52 have been threaded through a first opening 22*a* in the sliceform 10. The first retaining portion 52 is sized to be wider than the first opening 22*a*, thus preventing movement of the sliceform 10 away from the panel 32. Thus, a top edge of the sliceform elements 17 and 18 is positioned beneath a bottom edge of the first retaining portion 52. In some aspects, the first tab 50 is sized to be approximately the same width as the first opening 22*a* when the sliceform 10 is in the second three-dimensional configuration.

Similarly, the second tab 54 and the second retaining portion 56 have been threaded through a second opening 22*b* in the sliceform 10. The second retaining portion 56 is sized to be wider than the second opening 22*b*, thus preventing movement of the sliceform 10 away from the panel 32. Thus, a top edge of the sliceform elements 19 and 20 is positioned beneath a bottom edge of the second retaining portion 56. In some aspects, the second tab 54 is sized to be approximately the same width as the second opening 22*b* when the sliceform 10 is in the second three-dimensional configuration. In some aspects, the first retaining portion 52 may be threaded through the first opening 22*a* by manipulating the size thereof (e.g., by bending the first retaining portion 52 to a size less than the width of the first opening 22*a*). The second retaining portion 56 may be similarly manipulated to fit through the second opening 22*b*.

Figure 10:
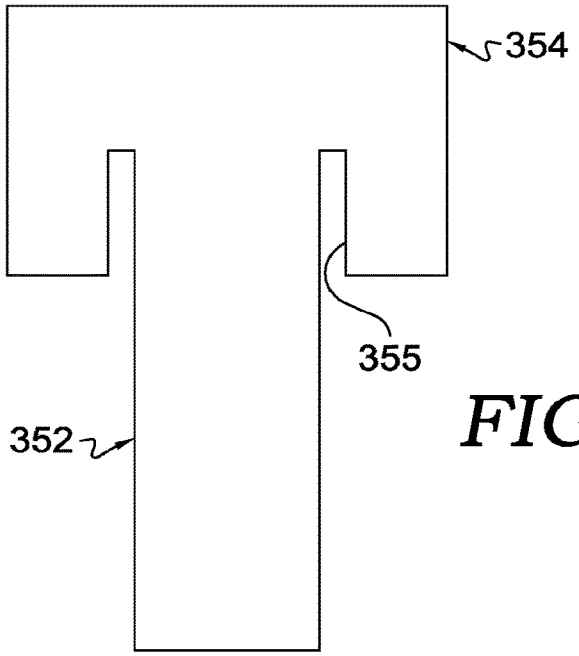
FIG. 10 is a top view of an alternative aspect of a first tab and a first retaining portion, in accordance with an embodiment of the present invention.
Figure 11:
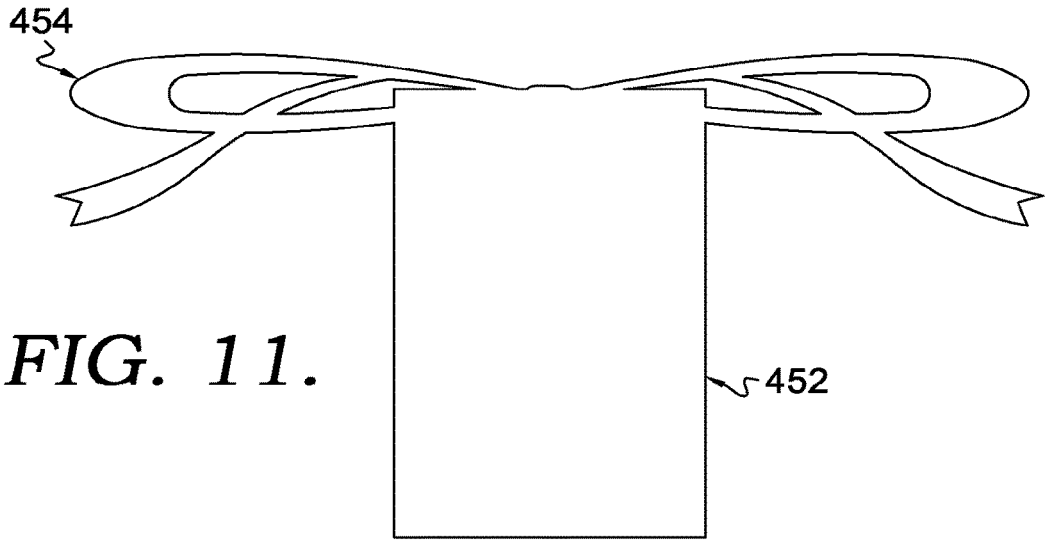
FIG. 11 is a top view of another alternative aspect of a first tab and a first retaining portion, in accordance with an embodiment of the present invention.
Figure 12:
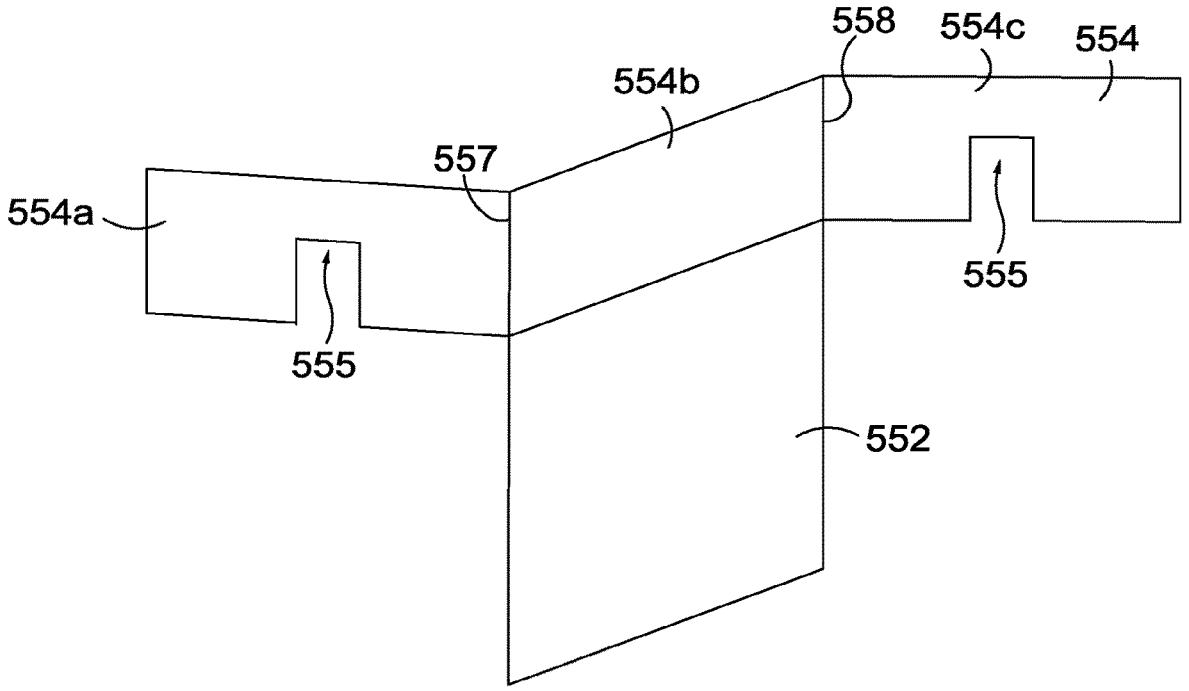
FIG. 12 is a perspective view of another alternative aspect of a first tab and a first retaining portion, in accordance with an embodiment of the present invention.

Alternative aspects of the first tab and the first retaining portion are illustrated in FIGS. 10, 11, and 12. For the sake of brevity, the following description will only discuss aspects of the first tab and the first retaining portion. The discussion of these aspects, however, applies equally to the second tab and the second retaining portion unless specifically noted otherwise.

FIG. 10 illustrates one aspect of a first tab 352 having a first retaining portion 354 and a first pair of slots 355 formed in the first retaining portion 354. As a result, the first tab 352 has a "T" shape. In some aspects, one or more of the panels comprising the sliceform may be received in the either or both of the first pair of slots 355. For example, the sliceform 10 may be secured to the foldable article 30 by the first tab 352 extending through the first passageway 22*a* and the first retaining portion 354 extending above panels 17 and 18 of the sliceform. Continuing with this example, one of the panels 17 and 18 may be received in each slot of the first pair of slots 355.

In some aspects, the panels 17 and 18 may have reciprocal slots aligned with the first pair of slots 355 such that a portion of the sliceform is received in the first pair of slots and a portion of the first retaining portion 354 is received in the slots of the sliceform panels. These aspects may allow the tab and retaining portion to secure the sliceform to the foldable article without the tab and retaining portion having to extend beyond the sliceform (e.g., the tab and retaining portion could have the same, or even a shorter, height above the foldable article than the sliceform elements being secured).

In other aspects, the sliceform may be oriented such that the first tab 352 is parallel to one set of panels (e.g., panels 11, 13, 15, 17, and 19) and perpendicular to the other set of panels (e.g., panels 12, 14, 16, 18, and 20). In these aspects, the first tab 352 may be positioned proximate to one of the panels it is parallel to. Thus, the sliceform and/or foldable article designer is permitted flexibility to obscure the first tab 352 from the overall design, if desired.

FIG. 11 illustrates another aspect of a first tab 452 having a first retaining portion 454. In this aspect, the first tab 452 and the first retaining portion 454 comprise a decorative element (e.g., a gift box with a ribbon). Thus, one or both of the first tab and the first retaining portion may include features that are functional for securing the sliceform to the foldable article while also providing the designer additional design options.

FIG. 12 illustrates one aspect of a first tab 552 having a first retaining portion 554 and a first pair of slots 555 formed in the first retaining portion 554. The first retaining portion 554 is coupled to the first tab 552 and includes a first area 554*a*, a second area 554*b*, and a third area 554*c*. The first area 554*a* and the third area 554*c* do not overlap the first tab 552 while the second area 554*b* overlaps the first tab 552. The first area 554*a* is separated from the second area 554*b* by a first fold 557 and the second area 554*b* is separated from the third area 554*c* by a second fold 558. One of the pair of slots 555 is formed in the first area 554*a* and the other is formed in the third area 554*c*. When employed to removably secure a sliceform to a foldable article, the first tab 552 is generally positioned parallel to one set of panels (e.g., panels 11, 13, 15, 17, and 19) and perpendicular to the other set of panels (e.g., panels 12, 14, 16, 18, and 20). In the illustrated aspect, both the first area 554*a* and the third area 554*c* are folded in the same direction (e.g., clockwise viewed from above) to be parallel with the other set of panels (e.g., panels 12, 14, 16, 18, and 20). As a result, the first tab 552 and retaining portion 554 has a "Z" shape when viewed from above.

In other aspects, the first fold 557 and/or the second fold 558 are not aligned with the edges of the first tab 552. Thus, a portion of the second area 554*b* may overlap the first tab 552 and one or more portions may extend beyond the edges of the first tab 552.

Several alternative embodiments of removably securing a sliceform to a foldable article have been disclosed. These embodiments perform very well and allow removal of the sliceform from the foldable article with minimal effort. In some circumstances, however, it is desirable to provide a more secure removable coupling between a sliceform and a foldable article. For example, in a retail setting it may be desirable to display a sliceform that is removably secured to a foldable article. In this setting, it may be preferred for a patron to not separate the sliceform from the foldable article. Thus, a tab structure that more securely couples the sliceform to the foldable article would be advantageous.

Referring now to FIGS. 13-16, an alternative tab structure is illustrated that may be used to more securely couple a sliceform to a foldable article while still permitting detachment therefrom. In the embodiment illustrated in FIG. 13, an exploded view shows a foldable article 630 that includes a panel 632 having a first subpanel 634 separated from a second subpanel 636 by a fold 638. Lifted away from the panel 632, is a third subpanel 640 and a fourth subpanel 642. Lifted further away is a sliceform 610. When the foldable article 630 is assembled, the third subpanel 640 is coupled to the first subpanel 634 and the fourth subpanel 642 is coupled to the second subpanel 636 on opposite sides of the fold 638. In other aspects, the third subpanel 640 and the fourth subpanel 642 may be integral to the panel 632, as discussed above with reference to FIG. 6.

Figure 14:
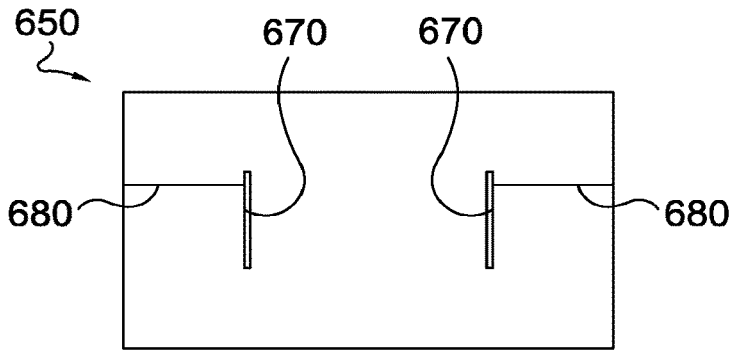
FIG. 14 is a front view of another alternative aspect of a first tab, in accordance with an embodiment of the present invention.
Figure 13:
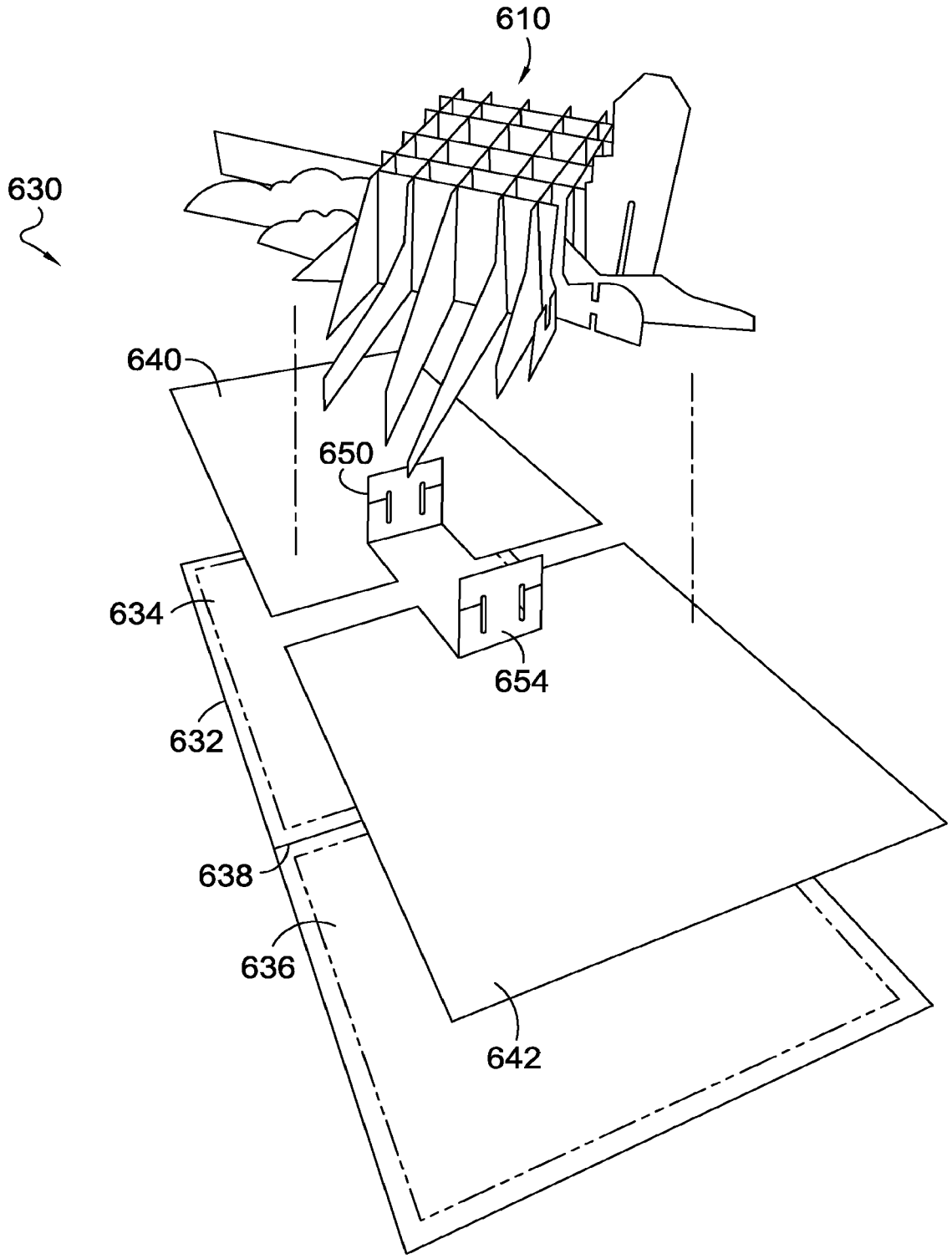
FIG. 13 is an exploded perspective view of a foldable article in an open position configured to have a sliceform removably secured thereto, in accordance with an embodiment of the present invention.

The third subpanel 640 includes a first tab 650 and the fourth subpanel 642 includes a second tab 654, as illustrated in FIGS. 13 and 14. For the sake of brevity, the following description will only discuss aspects of the first tab. The discussion of these aspects, however, applies equally to the second tab unless specifically noted otherwise.

Turning to FIG. 14, as illustrated the first tab 650 has a rectangular shape including a bottom edge, a left edge, a top edge and a right edge. In other aspects, the first tab 650 may have any other geometric or irregular shape, with one or more edges. As illustrated in FIG. 13, the bottom edge is integral to the third subpanel 640, but in other aspects the first tab 650 may be coupled to either the first subpanel 634 or the third subpanel 640 in other ways (e.g., a smaller tab integral to the third subpanel, a lip extending along the bottom edge of the first tab 650, etc.).

Figure 15:
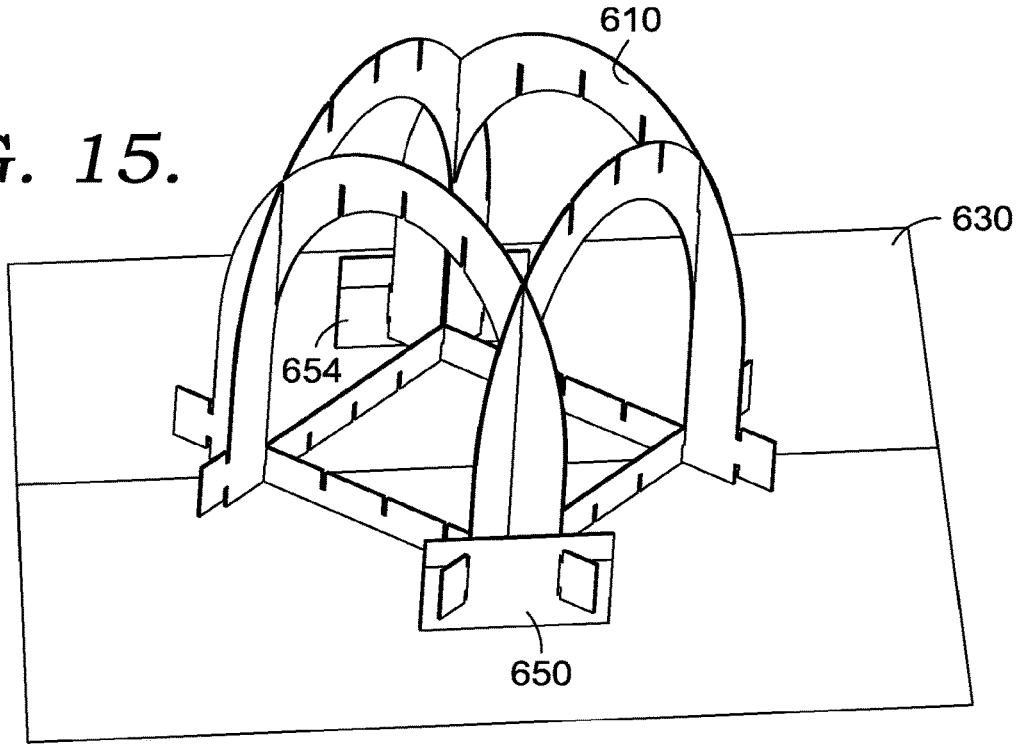
FIG. 15 is a perspective view of a foldable article in an open position having a sliceform removably secured thereto by the first tab shown in FIG. 14.
Figure 16:
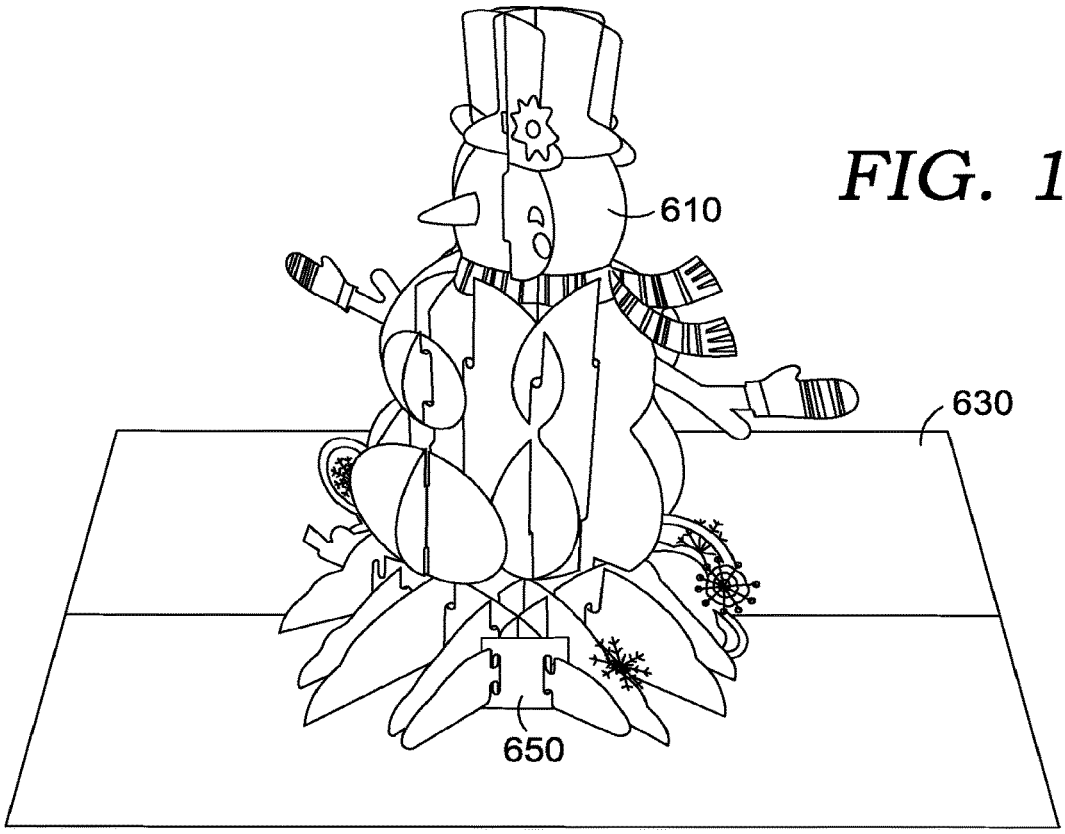
FIG. 16. is a perspective view of an alternative aspect of a foldable article in an open position having a sliceform removably secured thereto by the first tab shown in FIG. 14.

As illustrated in in FIGS. 13, 15 and 16, the first tab 650 may be hingedly secured to the foldable article 630 such that is may move between a folded, substantially flat configuration and an unfolded three-dimensional configuration, similar to the sliceform 610. In these illustrated aspects, when in the unfolded three-dimensional configuration the first tab 650 extends in a plane set at an angle to each of the elements of the sliceform 610. In alternative aspects, however, the first tab 650 may extend in a plane that is parallel to some of the elements of the sliceform 610. In further aspects, the second tab 654 may be similarly secured to the foldable article 630. In these aspects, the second tab 654 may extend in a plane parallel, or set at an angle, to that of the first tab 650 or that of some or all of the elements of the sliceform 610. For example, relative to the sliceform illustrated in FIG. 2, the first tab 650 may extend in direction A and removably secure adjacent sliceform panels extending in direction B.

In order to removably secure the sliceform 610 to the foldable article 630, the first tab 650 includes a pair of slots 670 formed therein. Each slot of the pair of slots 670 is positioned in the first tab 650 such that it may receive a sliceform 610 element therethrough. The pair of slots 670 do not extend to any of the edges of the first tab 650 (e.g., bottom edge, left edge, right edge, or top edge). As a result, the first tab 650 has the appearance of an "H" shape on its side. This structure more securely couples the sliceform 610 to the foldable article 630.

The first tab 650 is particularly effective when utilized in conjunction with sliceform 610 elements that have a top slot aligned with a bottom slot at the position received in the pair of slots 670 (as in the embodiment shown in FIG. 16), which forms a narrow portion of the sliceform element. Moreover, when the height of the sliceform 610 elements is taller than the length of the pair of slots 670 a particularly secure coupling is achieved. In such aspects, the sliceform 610 may be removably secured to the foldable article 630 in a number of ways. One way includes manipulating (e.g., bending, folding, etc.) the sliceform 610 element so that it may be threaded through one of the pair of slots 670 and then returning the sliceform 610 element to its original shape. However, this may not result in an aesthetically pleasing finished product. Thus, a preferred way to couple includes forming a respective cut 680 from an edge (e.g., right edge, left edge, etc.) of the first tab 650 to each one of the pair of slots 670. In this way, the sliceform element 610 may be passed through the cut 680 and into one of the pair of slots 670 without the necessity to bend or fold the taller portion of the sliceform 610 element. The cut 680 may be made at any angle relative to the slots 670. Likewise, the cut 680 may intersect the respective slot 670 at any point along its length or width. In alternative embodiments, the cut 680 may be made from any side of the first tab 650 (e.g., a left side, a right side, a bottom side, a top side, etc.) so long as it extends from a perimeter of the first tab 650 to the respective slot 670. In still other aspects, a first cut 680 may be made from an edge of the first tab 650 to a first slot 670 and a second cut 680 may be made from the from the first slot 670 to the second slot 680, which may allow two sliceform elements to be retained by the first tab 650.

FIGS. 15 and 16 illustrate sliceforms 610 removably secured to a foldable article 630 with the first tab 650 and the second tab 654 (not visible in FIG. 16). As is apparent from the illustrated embodiments, the "H" shaped tab structure is suitable for removably securing many different types of sliceforms 610 to a foldable article 630.

Although the "H" shaped tab structure has been described in reference to a first tab 650 that includes a pair of slots 670, alternative aspects may include only a single slot and a single cut extending from an edge of the tab to the slot. Thus, in these aspects each tab may only secure a single panel of the sliceform 610.

Some aspects of this disclosure have been described with respect to the illustrative examples provided by FIGS. 1-16. Additional aspects of the disclosure may be related to subject matter included in one or more claims of this application, or one or more related applications, but the claims are not limited to only the subject matter described in this description. These additional aspects may include features illustrated by FIGS. 1-16, features not illustrated by FIGS. 1-16, and any combination thereof. When describing these additional aspects, reference may or may not be made to elements depicted by FIGS. 1-16.

In one aspect the present invention is directed to a foldable article having a panel with a first subpanel and a second subpanel, the first subpanel and the second subpanel are separated by a fold in the panel, a first tab is coupled to the first subpanel and has a first slot and a second slot formed therein, a first cut extends from a first edge of the first tab to the first slot, a second cut extends from a second edge of the first tab to the second slot; and a sliceform is moveably coupled to the panel by the first tab such that the sliceform is moveable between a first collapsed, substantially flat configuration and a second three-dimensional configuration, wherein the sliceform is in the first collapsed, substantially flat configuration when the panel is folded closed along the fold, and wherein the sliceform is in the second three-dimensional configuration when the panel is unfolded and open.

In another aspect the present invention is directed to a foldable article having a panel with a first subpanel and a second subpanel, the first subpanel and the second subpanel being separated by a fold in the panel, a first tab having a retaining portion is coupled to the first subpanel, the retaining portion has a pair of slots formed therein and a sliceform is moveably coupled to the panel by the first tab such that the sliceform is moveable between a first collapsed, substantially flat configuration and a second three-dimensional configuration, wherein the sliceform is in the first collapsed, substantially flat configuration when the panel is folded closed along the fold, and wherein the sliceform is in the second three-dimensional configuration when the panel is unfolded and open.

From the foregoing it will be seen that this invention is one well adapted to attain all ends and objects hereinabove set forth together with the other advantages which are clear following the complete disclosure above and which are inherent to the methods and apparatuses described herein. It will be understood that certain features and sub combinations are of utility and may be employed without reference to other features and sub combinations. This is contemplated by and is within the scope of the invention and claims.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

The invention claimed is:

1. A foldable article comprising:

a first subpanel movable relative to a second subpanel about a common axis;

a first tab coupled to the first subpanel;

the first tab having a first slot and a second slot formed therein, a first cut extending from a first edge of the first tab to the first slot, a second cut extending from a second edge of the first tab to the second slot; and a sliceform moveably coupled to the first subpanel by the first tab such that the sliceform is moveable between a first collapsed, substantially flat configuration and a second three-dimensional configuration.

2. The foldable article of claim 1 further comprising:

a third subpanel affixed to the first subpanel, the first tab being integral to the third subpanel such that the first tab is proximate the common axis;

the first tab configured to move between a flat position where the first tab is substantially parallel with the third subpanel and a raised position where the first tab is substantially perpendicular to the third subpanel.

3. The foldable article of claim 1 further comprising:

the sliceform having a first sliceform element and a second sliceform element, each of the first and second sliceform elements including a narrow portion, each narrow portion comprising a pair of reciprocal slots extending towards one another from a top edge and a bottom edge of said sliceform element;

wherein the narrow portion of the first sliceform element is received through the first slot in the first tab and the narrow portion of the second sliceform element is received through the second slot in the first tab.

4. The foldable article of claim 1, wherein the sliceform comprises:

a plurality of first base panels; and a plurality of second base panels, wherein when the sliceform is in the second three-dimensional configuration, each of the plurality of first base panels is orthogonal to the first subpanel, the second subpanel, and each of the plurality of second base panels.

5. The foldable article of claim 4, wherein the first tab extends in a plane parallel to the plurality of first base panels when the sliceform is in the second three-dimensional configuration.

6. The foldable article of claim 4, wherein the first tab extends in a plane set at an angle to both the plurality of first base panels and the plurality of second base panels when the sliceform is in the second three-dimensional configuration.

7. The foldable article of claim 1 further comprising:

a second tab coupled to the second subpanel;

the second tab having a third slot and a fourth slot formed therein, a third cut extending from a third edge of the second tab to the third slot, a fourth cut extending from a fourth edge of the second tab to the fourth slot; and the sliceform moveably coupled to the second subpanel by the second tab such that the sliceform is moveable between the first collapsed, substantially flat configuration and the second three-dimensional configuration.

8. The foldable article of claim 1, wherein the first cut intersects the first slot proximate a first end of the first slot.

9. The foldable article of claim 1, wherein the first tab is moveable between a substantially flat configuration when the first subpanel is folded closed relative to the second subpanel and a raised configuration when the first subpanel is unfolded away from the second subpanel and open.

10. A foldable article comprising:

a panel having a first subpanel and a second subpanel, the first subpanel and the second subpanel being separated by a fold in the panel;

a first tab coupled to the first subpanel, the first tab having a first slot and a second slot formed therein, the first slot and the second slot being formed interior to a perimeter of the first tab; and a sliceform moveably coupled to the panel by the first tab such that the sliceform is moveable between a first collapsed, substantially flat configuration and a second three-dimensional configuration, wherein the sliceform is in the first collapsed, substantially flat configuration when the panel is folded closed along the fold, and wherein the sliceform is in the second three-dimensional configuration when the panel is unfolded and open.

11. The foldable article of claim 10, wherein the first tab includes a first area, a second area adjacent the first area, and a third area adjacent the second area, each said area extending laterally across a distal end of the first tab.

12. The foldable article of claim 11, wherein the first slot is formed in the first area and extends to the perimeter of the first tab and the second slot is formed in the third area and extends to the perimeter of the first tab.

13. The foldable article of claim 12, wherein the first slot extends up from a bottom edge of the first area and the second slot extends up from a bottom edge of the third area.

14. The foldable article of claim 11, wherein the second area is a central area positioned between the first area and the third area, the central area having a width equal to the width of the first tab.

15. The foldable article of claim 14, wherein the first area is separated from the central area by a first fold and the third area is separated from the central area by a second fold.

16. The foldable article of claim 15, wherein the first tab is moveable between a first substantially planar configuration and a second non-planar configuration, wherein the first tab is in the first substantially planar configuration when the panel is folded closed along the fold, wherein the first tab is in the second non-planar configuration when the panel is unfolded and open.

17. The foldable article of claim 16, wherein each of the first area and the third area extend perpendicular to the central area when the first tab is in the second non-planar configuration.

18. The foldable article of claim 16, wherein the first area extends away from a first side of the first tab and the third area extends away from a second side of the first tab when the first tab is in the second non-planar configuration.

19. The foldable article of claim 16, wherein the sliceform comprises a first plurality of sliceform elements extending in a first direction and a second plurality of sliceform elements extending in a second direction when the sliceform is in the second three-dimensional configuration, wherein the central area of the first tab extend in parallel to the first plurality of sliceform elements, and wherein the first area and the third area extend in parallel to the second plurality of sliceform elements.

* * * * *